US010717585B2

(12) United States Patent
Ishikawa et al.

(10) Patent No.: US 10,717,585 B2
(45) Date of Patent: Jul. 21, 2020

(54) CONTAINER FOR MICROWAVE OVEN

(71) Applicant: KYORAKU CO., LTD., Kyoto-shi, Kyoto (JP)

(72) Inventors: Shinji Ishikawa, Tokyo (JP); Kumio Maruyama, Osaka (JP)

(73) Assignee: KYORAKU CO., LTD., Kyoto (JP)

( * ) Notice: Subject to any disclaimer, the term of this patent is extended or adjusted under 35 U.S.C. 154(b) by 601 days.

(21) Appl. No.: 15/515,763

(22) PCT Filed: Sep. 16, 2015

(86) PCT No.: PCT/JP2015/076209
§ 371 (c)(1),
(2) Date: Mar. 30, 2017

(87) PCT Pub. No.: WO2016/052181
PCT Pub. Date: Apr. 7, 2016

(65) Prior Publication Data

US 2017/0305637 A1 Oct. 26, 2017

Related U.S. Application Data

(60) Provisional application No. PCT/JP2015/076209, filed on Sep. 16, 2015.

(30) Foreign Application Priority Data

Sep. 30, 2014 (JP) ..... 2014-199673
Sep. 30, 2014 (JP) ..... 2014-199674
Jan. 30, 2015 (JP) ..... 2015-017173

(51) Int. Cl.
*B65D 81/34* (2006.01)
*B65D 77/20* (2006.01)
(Continued)

(52) U.S. Cl.
CPC ..... *B65D 81/3453* (2013.01); *B65D 25/38* (2013.01); *B65D 47/32* (2013.01);
(Continued)

(58) Field of Classification Search
CPC ..... B65D 25/38; B65D 47/32; B65D 77/20; B65D 77/2036; B65D 77/2052; B65D 81/34; B65D 81/3453
See application file for complete search history.

(56) References Cited

U.S. PATENT DOCUMENTS 3,398,876 A 8/1968 Ward
9,757,886 B2 * 9/2017 Middleton ..... B29C 45/14336
(Continued)

FOREIGN PATENT DOCUMENTS

CN 101448718 A 6/2009
JP 3052161 U 9/1998
(Continued)

OTHER PUBLICATIONS

Translation JP2009120247 (Year: 2019).*
(Continued)

*Primary Examiner* — Ibrahime A Abraham
*Assistant Examiner* — Frederick F Calvetti
(74) *Attorney, Agent, or Firm* — Maier & Maier, PLLC

(57) ABSTRACT

An object is to provide a microwave container configured to precisely discharge vapor from a vapor-discharging part to avoid any vapor discharge from the remaining portions, and the microwave container includes: a container main body having an opening in its upper portion; a flange part formed to extend outwardly from the opening of the container main body; and a heat-seal part in a rib shape formed over the entire periphery of an upper surface of the flange part and heat-sealed to a film-shaped lid member for sealing the opening, wherein the heat-seal part includes a first heat-seal
(Continued)

part for discharging vapor generated in the container main body by breaking the heat seal with the lid member when the vapor reaches a predetermined pressure, and a second heat-seal part wider than the first heat-seal part.

15 Claims, 9 Drawing Sheets

(51) Int. Cl.
*B65D 25/38* (2006.01)
*B65D 47/32* (2006.01)

(52) U.S. Cl.
CPC ..... *B65D 77/20* (2013.01); *B65D 77/2036* (2013.01); *B65D 77/2052* (2013.01); *B65D 81/34* (2013.01)

(56) References Cited

U.S. PATENT DOCUMENTS

| | | | | |
|---|---|---|---|---|
| 2008/0044525 | A1 | 2/2008 | Fenn-Barrabass et al. | |
| 2009/0110784 | A1* | 4/2009 | Yasumuro | B65D 77/225 426/107 |
| 2009/0110785 | A1* | 4/2009 | Yasumuro | A47J 36/022 426/107 |
| 2014/0374953 | A1* | 12/2014 | Middleton | B29C 45/14336 264/275 |
| 2018/0067083 | A1 | 3/2018 | Shinada et al. | |
| 2018/0370713 | A1* | 12/2018 | Kado | B65D 77/2028 |

FOREIGN PATENT DOCUMENTS

| | | | |
|---|---|---|---|
| JP | 2002260590 | A | 9/2002 |
| JP | 2005247647 | A | 9/2005 |
| JP | 2006-096367 | A | 4/2006 |
| JP | 2006128037 | A | 5/2006 |
| JP | 2007029896 | A | 2/2007 |
| JP | 2007-308175 | A | 11/2007 |
| JP | 2009-120247 | A | 6/2009 |
| JP | 2010-23851 | A | 2/2010 |
| JP | 4539266 | B2 | 9/2010 |
| JP | 5050648 | B2 | 10/2012 |
| JP | 20141657488 | A | 9/2014 |
| WO | 2008/056690 | A1 | 5/2008 |
| WO | 2009091065 | A1 | 7/2009 |

OTHER PUBLICATIONS

Translation W02008/056690 (Year: 2019).*
Jun. 5, 2018 Office Action issued in Chinese Patent Application No. 201580001456.2.
May 16, 2018 Search Report issued in European Patent Application No. 15847308.2.
Dec. 28, 2015 International Search Report issued in International Patent Application No. PCT/JP2015/076209.
Dec. 28, 2015 Written Opinion issued in International Patent Application No. PCT/JP2015/076209.
First Office Action dated Nov. 12, 2019 in corresponding Japanese Patent Application No. 2016-175502; 4 pages.
First Office Action dated Nov. 12, 2019 in corresponding Japanese Patent Application No. 2016-175503; 3 pages.
First Office Action dated Nov. 12, 2019 in corresponding Japanese Patent Application No. 2016-175505; 3 pages.
Extended European Search Report dated Aug. 19, 2019, of corresponding European Application No. 19185494.2; 7 pgs.

* cited by examiner

[FIG. 1]
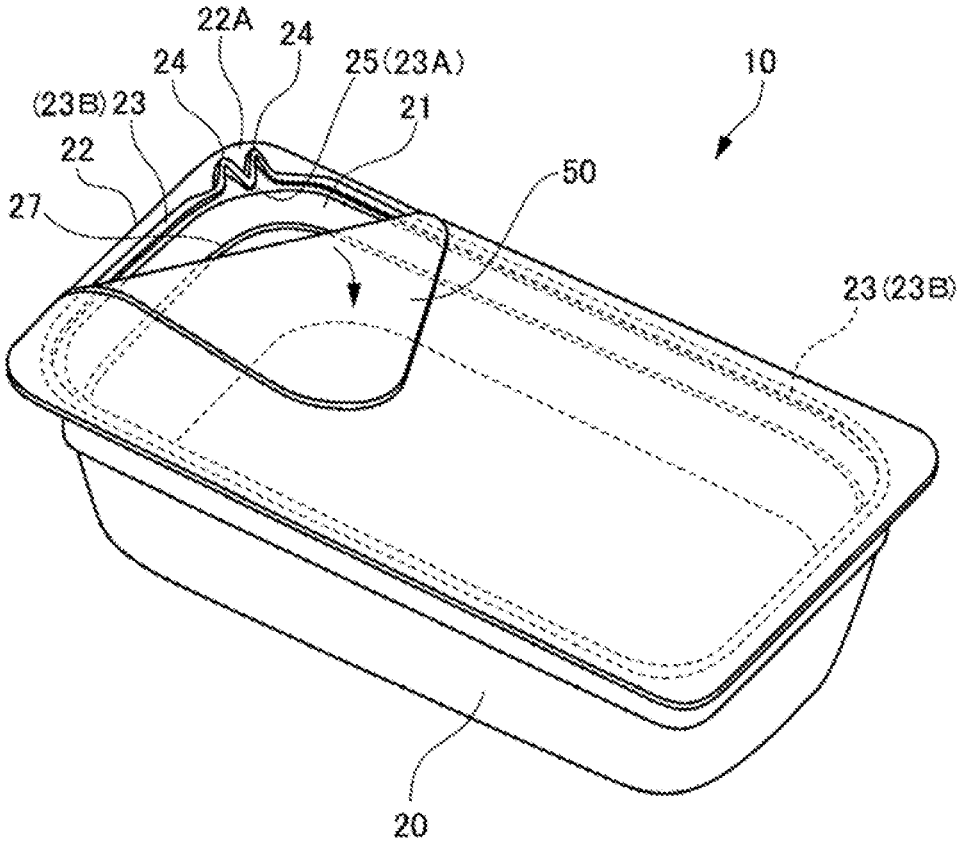

[FIG. 2]
(a)
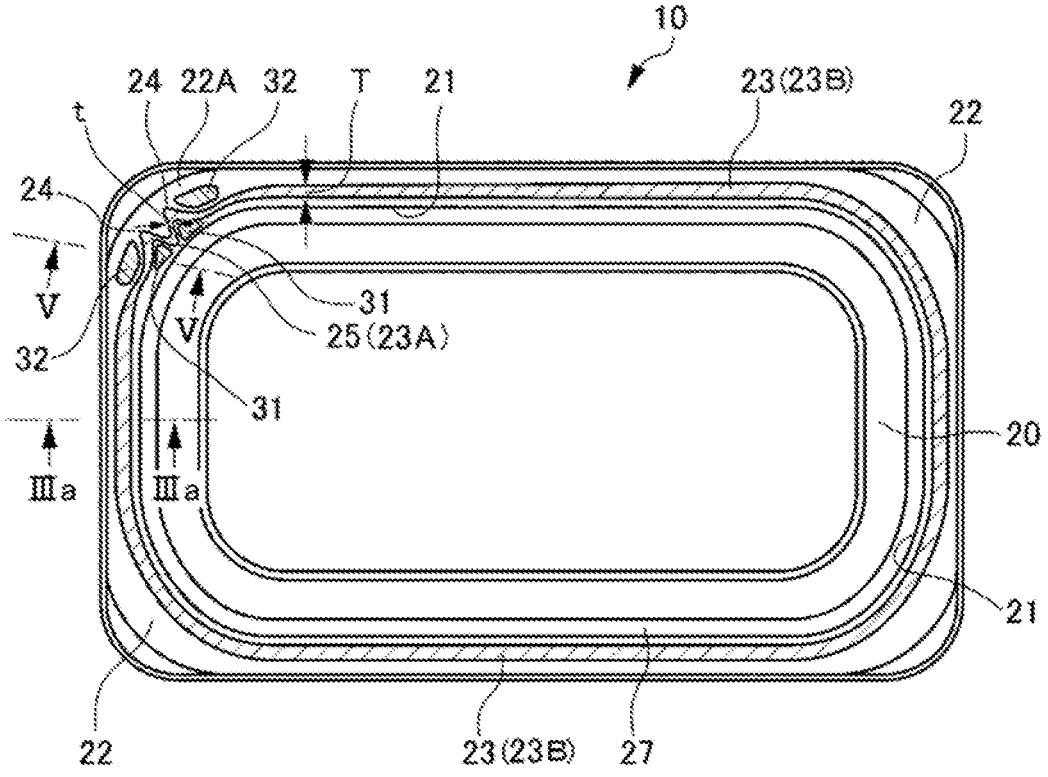
(b)
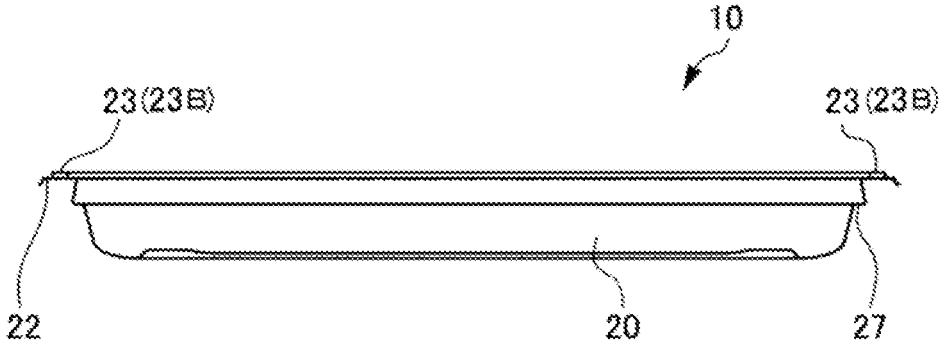

[FIG. 3]
(a)
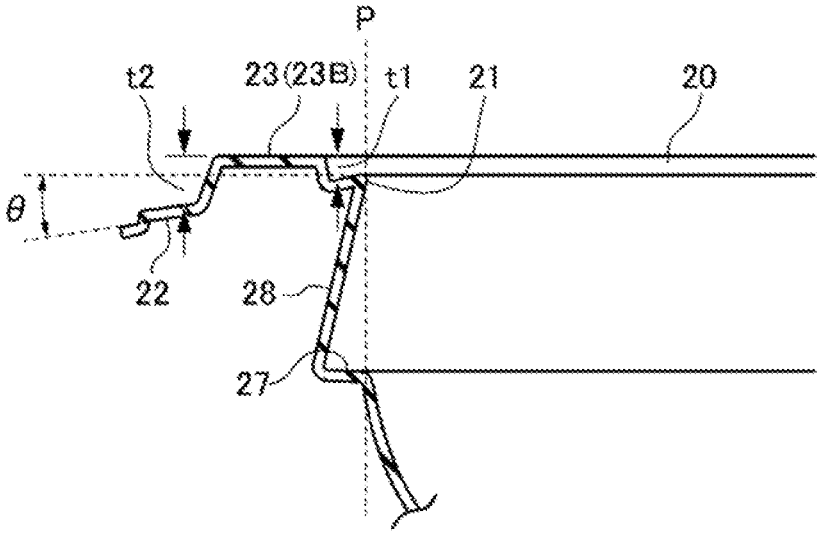
(b)
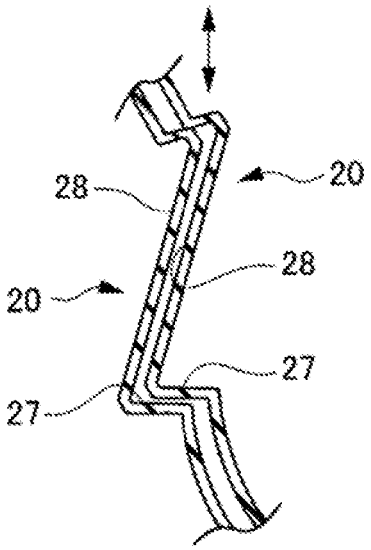

[FIG. 4]
(a)
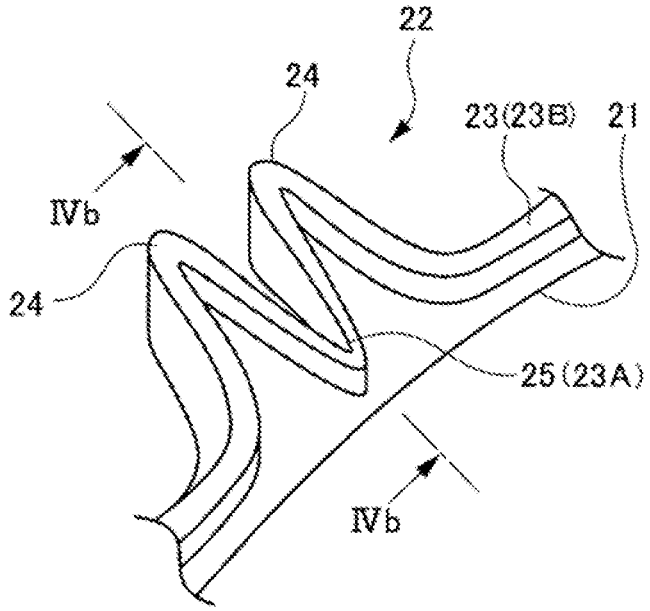
(b)
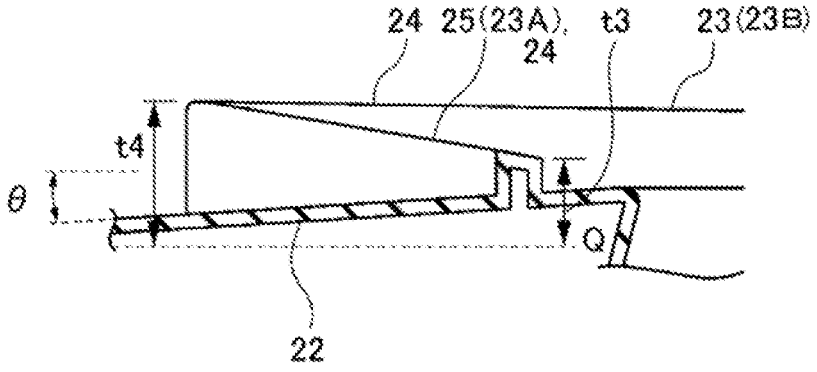

[FIG. 5]
(a)
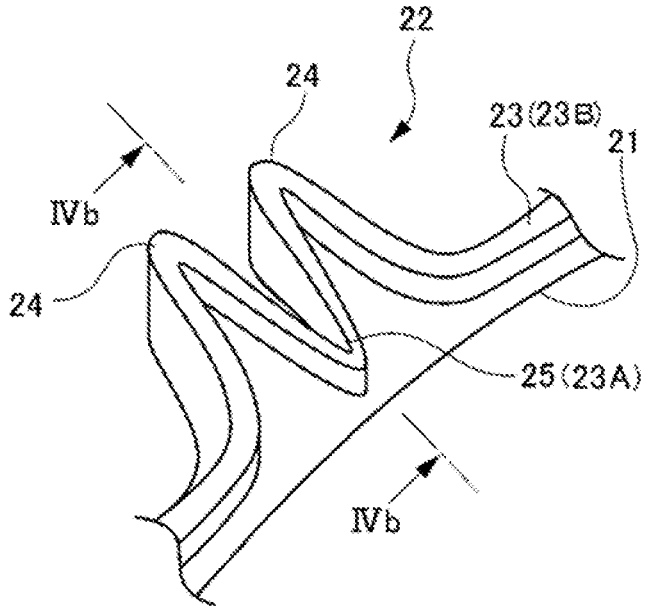
(b)
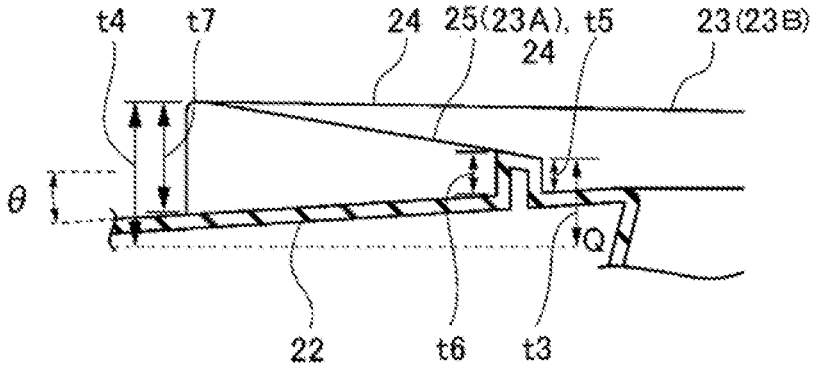

[FIG. 6]
(a)
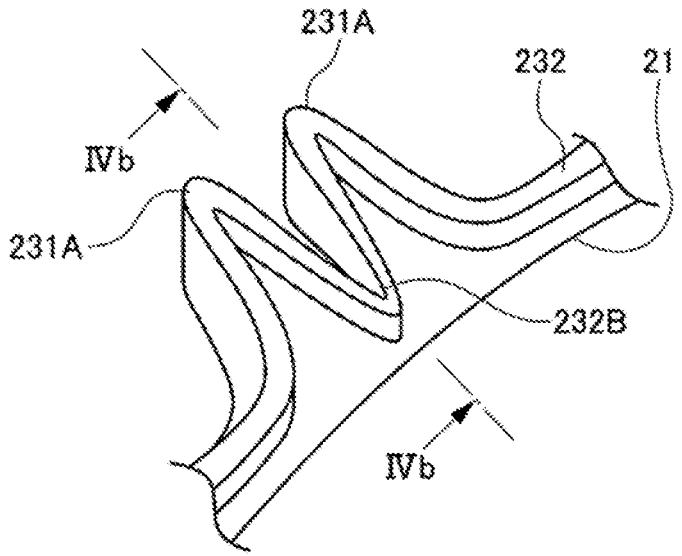
(b)
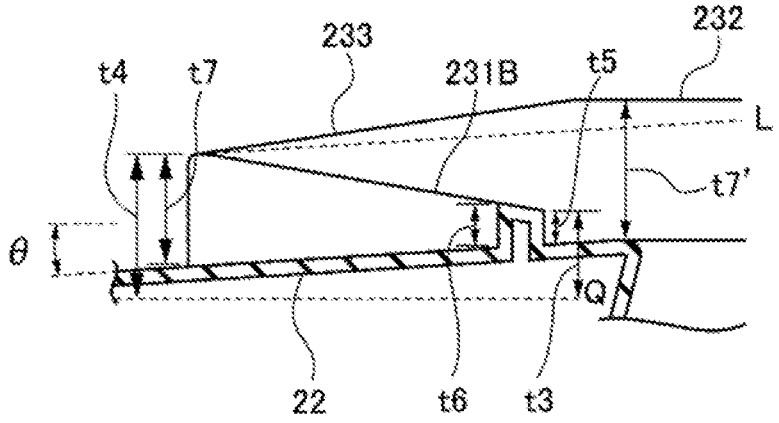

[FIG. 7]
(a)
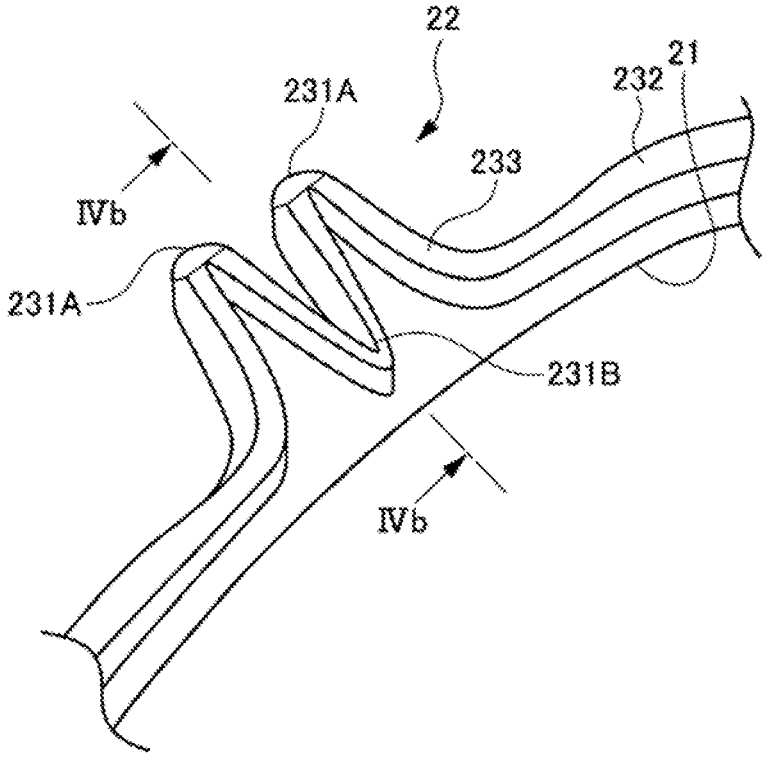
(b)
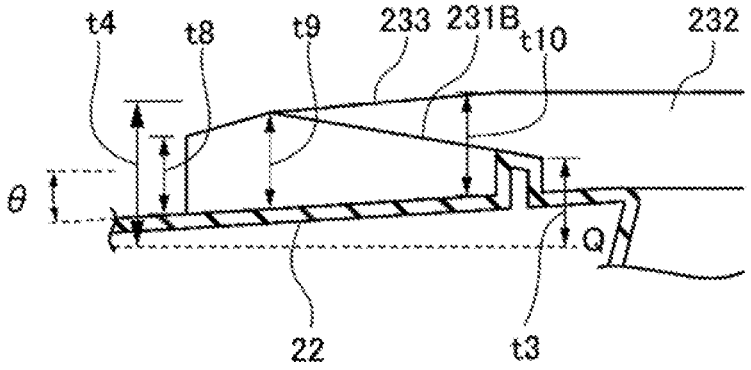

[FIG. 8]
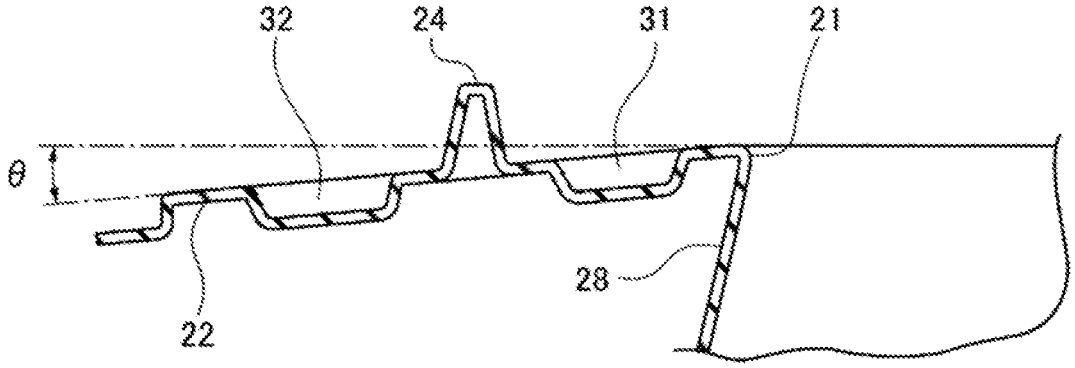

[FIG. 9]
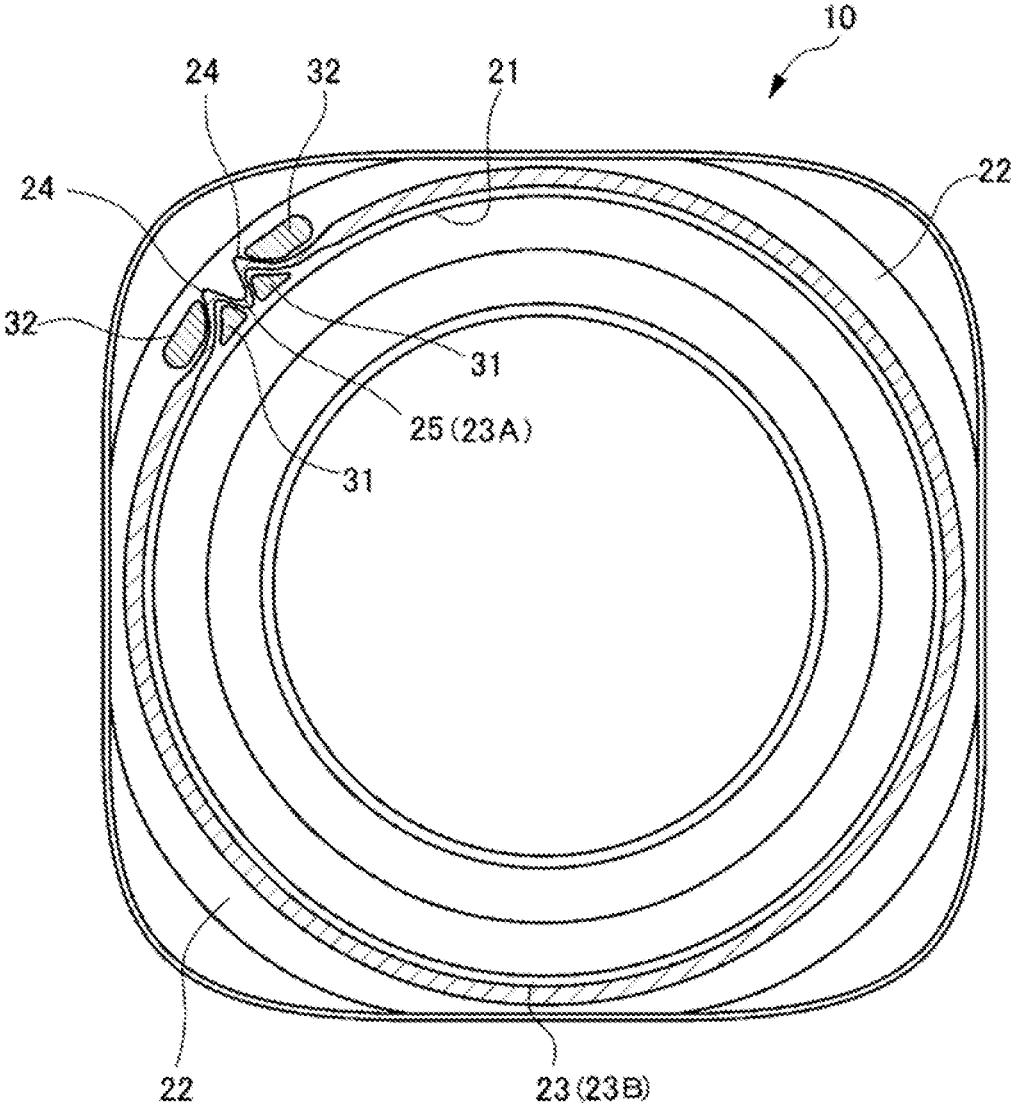

CONTAINER FOR MICROWAVE OVEN

TECHNICAL FIELD

The present invention relates to a microwave container.

BACKGROUND ART

A microwave container has, for example, as disclosed in Patent Literatures 1 and 2 described below, a flange part outwardly extending from an opening, and a rib-shaped heat-seal part is formed over the entire periphery of the upper surface of the flange part. The heat-seal part serves a part for heat seal of a film-shaped lid member for sealing the opening of the container. In a portion of the heat-seal part, a vapor-discharging part for carrying out so-called vapor discharge is formed. The vapor-discharging part is formed of a V-shaped part consisting of an opening pattern widening toward the outside. The vapor-discharging part configured as described above allows a stress to be concentrated on an inner sharpened tip of the V-shaped portion when the vapor generated in the container reaches a predetermined pressure, and therefore breaks the heat seal of the lid member.

However, both the vapor-discharging part and the remaining part of the heat-seal part are equal in heat seal width. Thus, the heat seal is increased in strength when their widths are equally extended, causing an insufficient vapor discharge from the vapor-discharging part. In contrast, when their widths are equally narrowed, the heat-seal part other than the vapor-discharging part inevitably causes an inappropriate vapor discharge.

Furthermore, the vapor-discharging part as configured as described above inevitably has its limitations as follows: In the case of controlling vapor to break the heat seal of the lid member without fail when the vapor reaches a predetermined pressure, there is a possible way to set a heat seal width of the heat-seal part to a predetermined value. In this case, however, such a way should be carried out in a narrow space.

CITATION LIST

Patent Literatures

[Patent Literature 1]
Japanese Patent No. 4539266
[Patent Literature 2]
Japanese Patent No. 505064

SUMMARY OF INVENTION

Technical Problem

The present invention has been made in view of such circumstances, and an object thereof is to provide a microwave container in which only a vapor-discharging part can perform a precision vapor discharge and portions other than the vapor-discharging part is able to avoid a vapor discharge.

Furthermore, another object is to provide a microwave container in which the heat seal of the lid member can be controlled to be broken when the vapor reaches a predetermined pressure.

Solution to Problem

The present invention will be understood by the following configurations.

(1) A first aspect of the microwave container of the present invention is a microwave container comprising: a container main body having an opening in an upper portion thereof; a flange part formed to extend outwardly from the opening of the container main body; and a heat-seal part in a rib shape formed over the entire periphery of an upper surface of the flange part and heat-sealed to a film-shaped lid member for sealing the opening, wherein the heat-seal part includes a first heat-seal part for discharging vapor generated in the container main body by breaking the heat seal with the lid member when the vapor reaches a predetermined pressure, and a second heat-seal part wider than the first heat-seal part.

(2) In the configuration of (1) as described above, the first heat-seal part may have a V-shaped portion widely opened to the outside, and the flange part may have recess portions on the opposite sides of the first heat-seal part in an outer area of the second heat-seal part (3) A second aspect of the microwave container of the present invention is a microwave container comprising: a container main body having an opening in an upper portion thereof; a flange part formed to extend outwardly from the opening of the container main body; and a heat-seal part formed over the entire periphery of an upper surface of the flange part and heat-sealed on a film-shaped lid member for sealing the opening, wherein the heat-seal part has a vapor-discharging part for breaking the heat seal with the lid member to discharge the vapor when the vapor generated in the container main body reaches a predetermined pressure. The vapor-discharging part is characterized in that it has V-shaped portion widely opened to the outside in plan view and, in side view, a tip located inside the V-shaped portion is inclined to be lowered toward the opening.

(4) In the configuration of (3) as described above, the flange part may have recess portions on the opposite sides of the vapor-discharging part in an outer area of the heat-seal part.

(5) In the configuration of (1) or (3) as described above, the flange part may be inclined such that an extended end thereof points downward, and the heat-seal part may be formed while an upper surface thereof is in a horizontal direction.

(6) In the configuration of (1) or (3) as described above, the container main body may have a step portion on its side surface, the step portion peripherally provided thereon and having a downwardly tapered diameter, and the side surface on the opening side may be outwardly inclined from the step portion with respect to a vertical direction.

(7) A third aspect of the microwave container of the present invention is a microwave container comprising: a container main body having an opening in an upper portion thereof; a flange part formed to extend outwardly from the opening of the container main body; and a heat-seal part formed over the entire periphery of an upper surface of the flange part and heat-sealed on a film-shaped lid member for sealing the opening, wherein the heat-seal part has a first heat-seal part for discharging vapor generated in the container main body by breaking the heat seal with the lid member when the vapor reaches a predetermined pressure, and a second heat-seal part higher than the first heat-seal part with respect to a protruding height from the upper surface of the flange part.

(8) In the configuration of (7) as described above, the first heat-seal part has a V-shaped portion widely opened to the outside.

(9) The configuration of (7) or (8) as described above may further have a gradually changing portion located in between the first heat-seal part and the second heat-seal part, wherein the protrusion height thereof is gradually higher from the first heat-seal part toward the second heat-seal part.

(10) In the configuration of any one of (7) to (9) as described above, the protrusion height of the second heat-seal part may be 1.1 to 2.5 times higher than the protrusion height of the first heat-seal part.

(11) In the configuration of any one of (7) to (10) as described above, the first heat-seal part may have one or more tips located outside the container main body, the tips being inclined to be lower toward an outer edge of the flange part.

Advantageous Effects of Invention

The microwave containers configured in this way, only a vapor-discharging part can perform a precision vapor discharge and portions other than the vapor-discharging part can avoid to discharge vapor.

Furthermore, the heat seal of the lid member can be controlled to be broken when the vapor reaches a predetermined pressure.

BRIEF DESCRIPTION OF DRAWINGS

FIG. 1 is a perspective view of the whole of a first embodiment of the microwave container of the present invention.

FIG. 2 (*a*) is a top view of a container main body, and

FIG. 2 (*b*) is a side view of the container main body.

FIG. 3 (*a*) is a cross-sectional view along IIIa-IIIa of FIG. 2(*a*), and FIG. 3 (*b*) is a cross-sectional view of a main part when two or more container main bodies are stacked one on top of the other.

FIG. 4 (*a*) is a perspective view of a lid-opening part and a vapor-discharging part, and FIG. 4 (*b*) is a cross-sectional view along the line IVb-IVb in (a), serving as a diagram illustrating a change in height of the vapor-discharging part with respect to a horizontal plane Q.

FIG. 5 (*a*) is a perspective view of a lid-opening part and a vapor-discharging part, and FIG. 5 (*b*) is a cross-sectional view along the line IVb-IVb in (a), serving as a diagram illustrating changes in heights of the respective portions of the vapor-discharging part relative to one another.

FIG. 6 is a diagram illustrating a second embodiment of the microwave container of the present invention, where (a) is a perspective view of a lid-opening part and a vapor-discharging part and (b) is a cross-sectional view along the line IVb-IVb in (a).

FIG. 7 is a diagram illustrating a third embodiment of the microwave container of the present invention, where (a) is a perspective view of a lid-opening part and a vapor-discharging part and (b) is a cross-sectional view along the line IVb-IVb in (a).

FIG. 8 is a cross-sectional view along the line V-V in FIG. 2 (*a*).

FIG. 9 is a top view illustrating the whole of a fourth embodiment of the microwave container of the present invention.

DESCRIPTION OF EMBODIMENTS

Hereinafter, with reference to the accompanying drawings, embodiments for carrying out the present invention (hereinafter, embodiments) will be described in detail. Throughout the description of the embodiments, except for some, like reference numerals are given to like elements.

First Embodiment

FIG. 1 is a perspective view of the whole of a microwave container of the present invention. A microwave container 10 illustrated in FIG. 1 comprises a container main body 20 and a lid member 50. Both the container main body 20 and the lid member 50 are made of resin material.

The container main body 20 has a substantially rectangular shape with rounded corners in plan view, and its upper portion has an opening 21. In addition, on the container main body 20, a flange part 22 is formed such that it extends outwardly from the opening 21. The flange part 22 has width wide portions 22A, which are wider than other portions, on the corners in plan view.

On the flange part 22, a rib-shaped heat-seal part 23, which is provided as a raised portion on the upper surface side, is formed. The heat-seal part 23 is formed over the entire circumference of the flange part 22. In other words, on the upper surface of the flange part 22, the heat-seal part 23 is formed to surround the opening 21 of the container main body 20.

The lid member 50 is in the form of a film with an outer periphery substantially the same size as the outer periphery of the flange part 22. After allowing the container main body 20 to house its contents (not shown), the lid member 50 is configured to be heat-sealed with the heat-seal part 23. In general, the lid member 50 is placed over the flange part 22 and then left as it is while being pressed for a period of time with a heated seal plate having a flat pressing surface that corresponds to the heat-seal part 23 of the flange part 22. In this case, the adhesion strength of the fuse-bonded portion can be determined by the temperature of the seal plate, the contact duration and pressure between the lid member 55 and the heat-seal part 23, and the materials of lid member 55 and heat-seal part 23. In FIG. 1, furthermore, there is illustrated a state in which the lid member 50 is partially peeled off from one of the corners of the flange part 22 after heating in a microwave oven.

Furthermore, the heat-seal part 23 has an "M"-shaped pattern at the one of the corners of the flange part 22, which serves a peeling-starting point of the lid member 50. This pattern makes a lid-opening part 24 and a vapor-discharging part 25 on the heat-seal part 23. In a first embodiment, the heat-seal part 23 including the vapor-discharging part 25 may be referred to as a first heat-seal part 23A, and the remaining part of the heat-seal part 23 is referred to as a second heat-seal part 23B.

FIG. 2 (*a*) is a top view of the container main body 20, and FIG. 2 (*b*) is a side view of the container main body 20. Note that illustration of the lid member 50 is omitted from FIGS. 1 (*a*) and (*b*).

As illustrated in FIG. 2(*a*), in the "M"-shaped pattern of the heat-seal part 23, a "V"-shaped pattern on the middle thereof (V-shaped portion widely opened to the outside) forms a vapor-discharging part 25, and reversed "V"-shaped patterns (V-shaped portions widely opened to the inside) on the opposite sides thereof form id-opening parts 24. In this case, the right-side portion of the vapor-discharging part 25 is formed in common with part of the lid-opening part 24 adjacent to the right side thereof, and the left-side portion of the vapor-discharging part 25 is formed in common with part of the lid-opening part 24 adjacent to the left side thereof.

For peeling the lid member 50 from the corner on which the lid-opening part 24 of the flange part 22 is formed, stress is concentrated on the sharpened tip of the reversed "V"-shaped pattern of the lid-opening part 24, exerting an effect of easily peeling the lid member 50. During heating in a microwave oven furthermore, vapor pressure generated in the container main body 20 causes concentrated stress on the sharpened tip of the "V"-shaped pattern of the vapor-discharging part 25. When the vapor pressure reaches a predetermined pressure, it exerts an effect of easily breaking the heat seal with the lid member 50.

In this vapor-discharging part 25, the heat-seal part 23 is partially formed into a "V"-shaped pattern as described above to have a narrower heat-seal width t than that of the remaining part of the heat-seal part 23. Providing the vapor-discharging part 25 with the comparatively narrow heat seal width t breaks the heat seal with the lid member 50 to make a selective vapor discharge from the V-shaped heat-seal part 23 easier. In addition, providing the part of the heat-seal part 23 other than the vapor-discharging part 25 exerts an effect of preventing the part other than the vapor-discharging part 25 from discharging vapor.

Here, a preferred aspect will be described for the case that the heat-seal part 23 is partially formed into a "V"-shaped pattern to make the heat seal width t thereof narrower than the heat seal width T of the remaining area of the heat-seal part 23, or the case that the heat seal width t is wider than the heat seal width t. The heat seal width t is preferably set to in a range of 0.5 to 2.0 mm, and the heat seal width T is preferably set to in a range of 2.0 to 5.0 mm. In this case, a ratio of the heat seal width T to the heat seal width t is preferably 1.5 to 4 times. This allows the heat seal with the lid member 50 of the vapor-discharging part 25 to be easily broken without fail and exerts an effect of preventing the part other than the vapor-discharging part 25 from discharging vapor.

FIG. 3 (*a*) is a cross-sectional view along IIIa-IIIa in FIG. 2 (*a*). As illustrated in FIG. 3 (*a*), the flange part 22 of the container main body 20 is formed such that an extended end thereof is downwardly inclined at an angle of θ (e.g., 6 degrees). The entire periphery of the flange part 22 is inclined in a manner substantially the same as such an inclination of the flange part 22. It is configured in previous consideration of warping of the container main body 20 in molding. In this case, the heat-seal part 23 is formed such that its upper surface is substantially kept in horizontal to ensure the reliability of heat seal with the lid member 50 (see FIG. 1). Thus, the heat-seal part 23 is formed such that the height t1 thereof relative to the flange part 22 on an inner peripheral side is smaller than the height t2 relative to the flange part 22 on an outer peripheral side.

FIG. 4 (*a*) is a perspective view of a lid-opening part 24 and a vapor-discharging part 25, which are formed on a width wide portion 22A of a flange part 22. FIG. 4 (*b*) is a cross-sectional view along the line IVb-IVb in FIG. 4 (*a*), serving as a diagram illustrating a change in height of the vapor-discharging part 25 with respect to a horizontal plane Q. As illustrated in FIGS. 4 (*a*) and (*b*), the vapor-discharging part 25 is formed such that in side view the tip thereof located inside the V-shaped portion is lowered toward the opening. Here, as illustrated in FIG. 4 (*b*), the flange part 22 is formed such that an extended end thereof is downwardly inclined at an angle of θ (e.g., 6 degrees), and formed such that the height t3 of the vapor-discharging part 25 with respect to the outer horizontal plane Q is lower than the height t4 thereof with respect to the outer horizontal plane Q.

In this case, the upper surface of the heat-seal part 23 (partially including the lid-opening part 24) other than the vapor-discharging part 25 is formed substantially horizontal in a manner similar to one illustrated in FIG. 3 (*a*). In this way, by inclining the vapor-discharging part 25 to allow the tip thereof located inside the V-shaped portion to be lowered toward the opening 21, the seal strength on the opening 21 side of the vapor-discharging part 25 can be weakened, thereby exerting an effect of easily discharging vapor. Thus, the heat seal of the lid member 50 can be controlled to be broken when the vapor reaches a predetermined pressure.

Referring now to FIGS. 5 (*a*) and (*b*) corresponding to FIGS. 4 (*a*) and (*b*), a preferable aspect in which the tip of the vapor-discharging part 25 located inside the V-shaped portion is downwardly inclined toward the opening 21 will be described. FIG. 5 (*a*) is, just as FIG. 4 (*a*), a perspective view of the lid-opening part 24 and the vapor-discharging part 25. FIG. 5 (*b*) is a cross-sectional view along the line IVb-IVb in FIG. 5 (*a*), serving as a diagram illustrating changes in heights of the respective portions of the vapor-discharging part 25 relative to one another. In FIG. 5 (*b*), the outer edge of the tip (left end in the figure) of the vapor-discharging part 25 on the widely opened side has a height t7 of preferably 1 to 5 mm, more preferably 1 to 3 mm from the flange part 22 for ensuring the thickness of a member provided for a microwave container. In average, approximately 1.2 mm is preferred.

Now, for the tip (right end in the figure) narrowed toward the opening 21, the height t6 of the outer edge of the right end (left-side outer edge on the right side in the figure) is 40 to 90% of the height t7 of the outer edge of the left end, and similarly the height t5 of the outer edge of the right end (right-side outer edge on the right side in the figure) is lowered so as to correspond 5 to 50% (approximately 30% in average). In this case, the height t5 is set to be lower than the height t6. This allows the tip of the V-shaped portion of the vapor-discharging part 25 is lower than the widely opened end portion, and simultaneously the inner edge of the tip itself is lower than the outer edge thereof. Thus, as it goes from the near side to the far side relative to the opening 21 of the container main body 20, the vapor-discharging part 25 can be shifted from a high seal strength portion to a weak seal strength portion in a relative manner.

Returning to FIG. 2 (*a*), in the flange part 22 in which the lid-opening part 24 and the vapor-discharging part 25 are formed, two recess portions 31 are formed on the opposite sides of the vapor-discharging part 25 and on the inner side of the heat-seal part 23 (partially including the lid-opening part 24). Furthermore, two recess portions 32 are also formed on the opposite sides of the vapor-discharging part 25 and on the outer side of the heat-seal part 23 (partially including the lid-opening part 24). The heat-seal part 23, which is formed so as to surround the opening 21 of the container main body 20, is preferably formed in the vicinity of the opening 21. Thus, a portion of each lid-opening part 24 on the side opposite to the vapor-discharging part 25 is configured as a pattern contiguous to the heat-seal part 23 with a steep slope. On the outside of the heat-seal part 23, therefore, a sufficient space between the flange part 22 (width wide portion 22A) and the heat-seal part 23 can be ensured to form the above recess portions 32 in the space.

As illustrated in FIG. 8, which is a cross-sectional view along the line V-V in FIG. 2 (*a*), these recess portions 31, 32 can make the height of the heat-seal part 23 (lid-opening part 24) high relative to the bottom surfaces of the recess portions 31, 32, exerting an effect of preventing the lid member 50 (see FIG. 1) from attaching to the flange part 22 when sealing. Furthermore, recess portions may be formed in a portion expanded toward the outside of the V-shaped portion of the vapor-discharging part 25. However, this portion is hardly formed because it is an extremely narrow area. Alternatively, the above recess portions 32 can be formed to exert a similar effect.

Referring back to FIG. 3 (*a*), a step portion 27 is formed on the side surface of the container main body 20 such that the step portion is peripherally provided thereon and has a downwardly tapered diameter. The side surface 28 on the opening 21 side is outwardly inclined from the step portion 27 with respect to a vertical direction (represented by the dotted line P in the figure). When two or more container main bodies 20 are stacked one on top of the other as illustrated in FIG. 3 (*b*), such a step portion 27 on the side surface of the container main body 20 serves as a stopper for preventing the upper container main body 20 from being housed deeply in the lower container main body 20. Inclining the side surface 28 on the opening 21 side outwardly from the step portion 27 with respect to a vertical direction exerts an effect of easily pulling the upper container main body 20 out of the lower container main body 20.

Second Embodiment

In a second embodiment as well as a third embodiment described below, a heat-seal part 23 is formed on a flange part 22 and protruded upward, thereby being provided as a raised portion on the upper surface side the flange part 22. A lid-opening part 231A and a vapor-discharging part 231B are formed on the heat-seal part 23. Both the lid-opening part 231A and the vapor-discharging part 231B are correctively referred to as a first heat-seal part 231, and the remaining heat-seal part 23 is referred to as a second heat-seal part 232. FIG. 6 (*a*) is a perspective view of the lid-opening part 231A and the vapor-discharging part 231B, which are formed on a width wide portion 22A of the flange portion 22. FIG. 6 (*b*) is a cross-sectional view along the line IVb-IVb in FIG. 6 (*a*). As illustrated in FIGS. 6 (*a*) and (*b*), the vapor-discharging part 231B is formed such that in side view the tip thereof located inside the V-shaped portion is lowered toward the opening. As illustrated in FIG. 6 (*b*), the flange part 22 is formed such that an extended end thereof is downwardly inclined at an angle of θ (e.g., 6 degrees), and formed such that the height t3 of the vapor-discharging part 231B with respect to the outer horizontal plane Q is lower than the height t4 thereof with respect to the outer horizontal plane Q.

In this case, the upper surface of the second heat-seal part 232 (partially including the lid-opening part 231A) other than the vapor-discharging part 231B is formed substantially horizontal in a manner similar to one illustrated in FIG. 3 (*a*). In this way, by inclining the vapor-discharging part 231B to allow the tip thereof located inside the V-shaped portion to be lowered toward the opening 21, the seal strength on the opening 21 side of the vapor-discharging part 231B can be weakened, thereby exerting an effect of easily discharging vapor. Thus, the heat seal of the lid member 50 can be controlled to be broken when the vapor reaches a predetermined pressure.

Here, a preferable aspect in which the tip of the vapor-discharging part 231B located inside the V-shaped portion is downwardly inclined toward the opening 21 will be described. In FIG. 6 (*b*), the outer edge of the tip (left end in the figure) of the vapor-discharging part 231B on the widely opened side has a height t7 of preferably 1 to 5 mm, more preferably 1 to 3 mm from the flange part 22 for ensuring the thickness of a member provided for a microwave container. In average, approximately 1.2 mm is preferred.

Now, for the tip (right end in the figure) narrowed toward the opening 21, the height t6 of the outer edge of the right end (left-side outer edge on the right side in the figure) is 40 to 90% of the height t7 of the outer edge of the left end, and similarly the height t5 of the outer edge of the right end (right-side outer edge on the right side in the figure) is lowered so as to correspond 5 to 50% (approximately 30% in average). In this case, the height t5 is set to be lower than the height t6. This allows the tip of the V-shaped portion of the vapor-discharging part 231B is lower than the widely opened end portion, and simultaneously the inner edge of the tip itself is lower than the outer edge thereof. Thus, as it goes from the near side to the far side relative to the opening 21 of the container main body 20, the vapor-discharging part 231B can be shifted from a high seal strength portion to a weak seal strength portion in a relative manner.

In the second embodiment, at the second heat-seal part 232, the protrusion height from the upper surface of the flange part 22 is formed such that it is higher than the first heat-seal part 231 in a manner as described below. That is, the second heat-seal part 232 is formed such that a protrusion height 7' from the flange part 22 at the head of the second heat-seal part 232 is higher than the protrusion height t7 at the V-shaped expanding end of the lid-opening part 231A. In the figure, furthermore, the broken line L is a virtual line indicating the protrusion height t7. Since the second heat-seal part 232 is configured to be higher than the first heat-seal part 231, in a step of sealing the lid member 50 on the heat-seal part of the flange part 22, the pressure applied on the heat-seal part by a flat seal plate can be lowered on the first heat seal part 231 as compared with the second heat seal part 232. Thus, suitably setting the difference between the protrusion height of the first heat-seal part and the protrusion height of the second heat-seal part allows, in particular, the adhesion strength of the first heat-seal part 231 provided as a vapor-discharging part to be easily adjusted.

From the point of view of adjusting the adhesion strength of the lid member 50 on the vapor-discharging part, a ratio between the protrusion height of the first heat-seal part and the protrusion height of the second heat-seal part is set such that the protrusion height of the second heat-seal part is 1.1 to 2.5 times higher than the protrusion height of the first heat-seal part. For example, it is preferred to set the protrusion height of the second heat-seal part to 1.5 mm when the protrusion height of the first heat-seal part is 1.0 mm.

A gradually changing portion 233 is provided in between the first heat-seal part 231 and the second heat-seal part 232 such that it is gradually changed from the protrusion height of the first heat-seal part 231 to the protrusion height of the second heat-seal part 232. Providing the gradually changing portion 233 allows the protrusion height to be smoothly changed. Thus, any undesired effects on the fusion bonding between the lid member 50 and the container main body 20 due to variations in the protrusion height.

Third Embodiment

FIG. 7 (*a*) is a perspective view of a first thermal heat-seal part 231 formed on a width wide portion 22A of a flange part 22, i.e., a lid-opening part 231A and a vapor-discharging part 231B, and a second heat-seal part 232 integrally adjacent to the first heat-seal part 232. FIG. 7 (*b*) is a cross-sectional view along the line IVb-IVb in FIG. 7 (*a*). As illustrated in FIGS. 7 (*a*) and (*b*), the tip of the lid-opening part 231A of the first heat-seal part 231, which is located on the outside of the container main body 20, may be inclined to be lowered toward the outer edge of the flange part 22. In other words, the protrusion height t8 of the lid-opening part 231A from the flange part 22 on the outside of the V-shaped expanding end of the lid-opening part 231A is lower than the protrusion height t9 from the flange part 22 on the inside thereof. With this configuration, it can be opened easily. In this case, both the tips of the lid-opening part 231A, which are located on the outside of the container main body 20, are inclined. Alternatively, one of the tips may be inclined, or one or more of the tips may be inclined.

Just as the second embodiment, the vapor-discharging part 231B is formed such that in side view the tip thereof located inside the V-shaped portion is lowered toward the opening. Here, as illustrated in FIG. 7 (*b*), the flange part 22 is formed such that an extended end thereof is downwardly inclined at an angle of θ (e.g., 6 degrees), and formed such that the height t3 of the vapor-discharging part 231B with respect to the outer horizontal plane Q is lower than the height t4 thereof with respect to the outer horizontal plane Q. Advantageous effects and preferred embodiments of this aspect are similar to those of the second embodiments, and their descriptions are thus omitted.

In the third embodiment, at the second heat-seal part 232, the protrusion height from the upper surface of the flange part 22 is formed such that it is higher than the first heat-seal part 231 in a manner as described below. That is, the second heat-seal part 232 is formed such that a protrusion height 10 from the flange part 22 at the head of the second heat-seal part 232 is higher than the protrusion height t9 at the V-shaped expanding end of the lid-opening part 231A. Since the second heat-seal part 232 is configured to be higher than the first heat-seal part 231, in a step of sealing the lid member 50 on the heat-seal part of the flange part 22, the pressure applied on the heat-seal part by a flat seal plate can be lowered on the first heat seal part 231 as compared with the second heat seal part 232. Thus, suitably setting the difference between the protrusion height of the first heat-seal part and the protrusion height of the second heat-seal part allows, in particular, the adhesion strength of the first heat-seal part 231 provided as a vapor-discharging part to be easily adjusted.

From the point of view of adjusting the adhesion strength of the lid member 50 on the vapor-discharging part, a ratio between the protrusion height t9 and the protrusion height t10 is set such that the protrusion height t10 is 1.1 to 2.5 times higher than the protrusion height t9. For example, it is preferred to set the protrusion height t10 to 1.5 mm when the protrusion height t9 is 1.0 mm.

A gradually changing portion 233 is provided in between the first heat-seal part 231 and the second heat-seal part 23 such that the protrusion height of the gradually changing portion 233 is gradually changed from the protrusion height t9 of the first heat-seal part 231 to the protrusion height t10 of the second heat-seal part 232. Providing the gradually changing portion 233 allows the protrusion height to be smoothly changed. Thus, any undesired effects on the fusion bonding between the lid member 50 and the container main body 20 due to variations in the protrusion height.

Fourth Embodiment

In the first to third embodiments as described above, the exemplified microwave container 10 is one in which the container main body 20 is formed in a substantially rectangular shape with rounded corners in plan view, and the flange part 22 is formed in a substantially rectangular shape in plan view and has the width wide portion 22A on the corner. However, it is not limited to such a configuration. Obviously, as illustrated in FIG. 9, for example, an applicable container main body 20 may be of a substantially circular shape in plan view in which a flange part 22 is of a square shape in plan view and each corner has a wide portion 22A.

Fifth Embodiment

In the first to fourth embodiments as described above, the lid-opening parts 24 are continuously formed on the both sides of the vapor-discharging part 25 with a common portion. Obviously, however, they may be formed as separated parts. Needless say, for example, a vapor-discharging part 25 may be formed on at least one corner among four corners of a flange part 22, and a lid-opening part 24 may be formed on at least one of the remaining corners.

Although the invention has been described with reference to the embodiments, it goes without saying that the technical scope of the present invention is not limited to the scope described in the above embodiments. It is apparent to those skilled in the art that various changes or modifications can be made to the above embodiments. It is also apparent from the description of claims that any forms with such changes or modifications can be included in the technical scope of the present invention.

REFERENCE SIGN LIST

10 . . . Microwave container, 20 . . . Container main body, 21 . . . Opening, 22 . . . Flange part, 22A . . . Width wide portion, 23 . . . Heat-seal part, 23A . . . First heat-seal part (first embodiment), 23B . . . Second heat-seal part (first embodiment), 231 . . . First heat-seal part (second and third embodiments), 231A . . . Lid-opening part, 231B . . . Vapor-discharging part, 232 . . . Second heat-seal part (second and third embodiments), 233 . . . Gradually changing portion, 24 . . . Lid-opening part, 25 . . . Vapor-discharging part, 27 . . . step portion, 28 . . . Side surface (side surface on the opening 21 side relative to step portion 27), 31 . . . Recess portion, 32 . . . Recess portion, 50 . . . Lid member.

The invention claimed is:

1. A microwave container comprising:

a container main body having an opening in an upper portion thereof;

a flange part formed to extend outwardly from the opening of the container main body;

a heat-seal part formed over the entire periphery of an upper surface of the flange part and heat-sealed to a film-shaped lid member for sealing the opening, wherein the heat-seal part includes a first heat-seal part for discharging vapor generated in the container main body by breaking the heat seal with the lid member when the vapor reaches a predetermined pressure, and a second heat-seal part wider than the first heat-seal part, the heat-seal part includes an M-shaped pattern comprising the first heat-seal part formed by a V-shaped pattern on the middle and a lid-opening part formed by a reversed V-shaped pattern on both sides of the first heat-seal part, the width of the second heat-seal part is wider than the width of the M-shaped pattern.

2. The microwave container as described in claim 1, wherein the first heat-seal part has a V-shaped portion widely opened to the outside, and the flange part has recess portions on the opposite sides of the first heat-seal part in an outer area of the second heat-seal part.

3. A microwave container comprising:

a container main body having an opening in an upper portion thereof;

a flange part formed to extend outwardly from the opening of the container main body; and a heat-seal part formed over the entire periphery of an upper surface of the flange part and heat-sealed to a film-shaped lid member for sealing the opening, wherein the heat-seal part has a first heat-seal part and a second heat-seal part, the first heat-seal part is a vapor-discharging part configured to break the heat seal of the lid member to discharge vapor when vapor generated in the container main body reaches a predetermined pressure, and the second heat-seal part is a part other than the vapor-discharging part, the vapor-discharging part is formed by a V-shaped portion widely opened to the outside in plan view, and a seal strength of the vapor-discharging part is weakened toward a tip located inside the V-shaped portion.

4. The microwave container as described in claim 3, wherein the flange part has recess portions on the opposite sides of the vapor-discharging part in an outer area of the heat-seal part.

5. The microwave container as described in claim 1, wherein the flange part is inclined while an extended end thereof points downward, and the heat-seal part is formed while an upper surface thereof is in a horizontal direction.

6. The microwave container as described in claim 1, wherein the container main body has a step portion on its side surface, the step portion peripherally provided thereon and having a downwardly tapered diameter, and the side surface on the opening side is outwardly inclined from the step portion with respect to a vertical direction.

7. A microwave container comprising:

a container main body having an opening in an upper portion thereof;

a flange part formed to extend outwardly from the opening of the container main body; and a heat-seal part formed over the entire periphery of an upper surface of the flange part and protruded upward, and heat-sealed on a film-shaped lid member for sealing the opening, wherein the heat-seal part includes a first heat-seal part and a second heat-seal part constituting the entire periphery of the flange part, the first heat-seal part is a part for discharging vapor generated in the container main body by breaking the heat seal with the lid member when the vapor reaches a predetermined pressure, and the second heat-seal part is a part other than the first heat-seal part, and is higher than the first heat-seal part with respect to a protruding height from the upper surface of the flange part.

8. The microwave container as described in claim 7, wherein the first heat-seal part has a V-shaped portion widely opened to the outside.

9. The microwave container as described in claim 7, further comprising:

a gradually changing portion located in between the first heat-seal part and the second heat-seal part, wherein the protrusion height thereof is gradually higher from the first heat-seal part toward the second heat-seal part.

10. The microwave container as described in claim 7, wherein the protrusion height of the second heat-seal part is 1.1 to 2.5 times higher than the protrusion height of the first heat-seal part.

11. The microwave container as described in claim 7, wherein the first heat-seal part has one or more tips located outside the container main body, the tips being inclined to be lower toward an outer edge of the flange part.

12. The microwave container as described in claim 8, further comprising:

a gradually changing portion located in between the first heat-seal part and the second heat-seal part, wherein the protrusion height thereof is gradually higher from the first heat-seal part toward the second heat-seal part.

13. The microwave container as described in claim 8, wherein the protrusion height of the second heat-seal part is 1.1 to 2.5 times higher than the protrusion height of the first heat-seal part.

14. The microwave container as described in claim 9, wherein the protrusion height of the second heat-seal part is 1.1 to 2.5 times higher than the protrusion height of the first heat-seal part.

15. The microwave container as described in claim 12, wherein the protrusion height of the second heat-seal part is 1.1 to 2.5 times higher than the protrusion height of the first heat-seal part.

* * * * *